United States Patent [19]

Okura

[11] Patent Number: 4,811,636

[45] Date of Patent: Mar. 14, 1989

[54] RATCHET DEVICE ADAPTABLE TO VARIOUS SCREW-ROTATING TOOLS

[76] Inventor: Masahiko Okura, 11-7, 4-chome, Siroganedai, Minatoku, Tokyo, Japan

[21] Appl. No.: 178,919

[22] Filed: Apr. 7, 1988

[51] Int. Cl.[4] ..... B25B 13/76

[52] U.S. Cl. ..... 81/63.2; 81/63

[58] Field of Search ..... 81/63, 63.2 R, 60, 584

[56] References Cited

U.S. PATENT DOCUMENTS 4,307,632 12/1981 Penner ..... 81/63

*Primary Examiner*—Frederick R. Schmidt
*Assistant Examiner*—Lawrence Cruz
*Attorney, Agent, or Firm*—Moonray Kojima

[57] ABSTRACT

Disclosed herein is a simple and compact ratchet device comprises a ratchet wheel, a pawl and a pin member preventing reversal of motion, which is provided integrally with portions adaptable to various screw-rotating tools on the market.

1 Claim, 2 Drawing Sheets base body
cylinder like portion
nut form portion
ratchet wheel axis
pawl

RATCHET DEVICE ADAPTABLE TO VARIOUS SCREW-ROTATING TOOLS

The ratched device of this invention comprises a ratchet wheel, a pawl and a pin member preventing reversal of motion and is provided integrally with portions adaptable to various screw-totating tools on the market, such as extension bar, plug wrench, socket adapter, etc., in each independent or combined conditions.

DESCRIPTION OF THE PREFERRED EMBODIMENT

Figure 4:
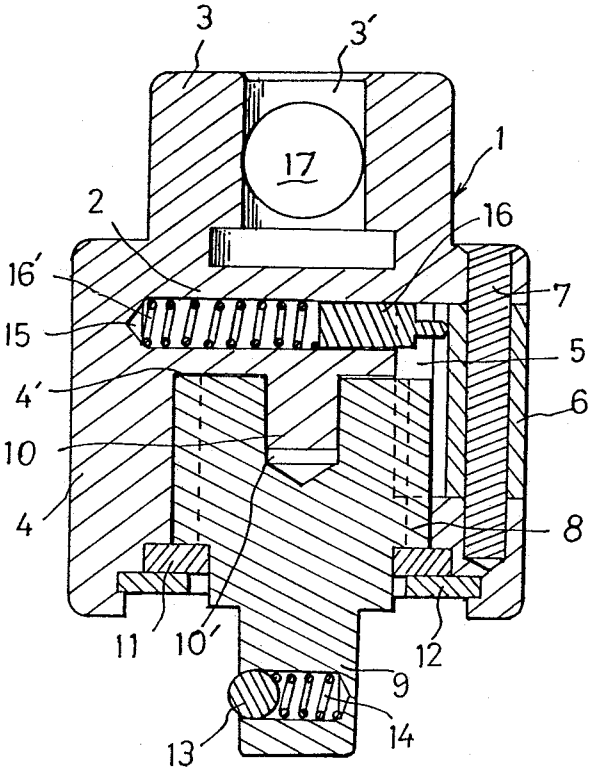
FIG. 4 is a sectional elevation along vertical center line of the FIG. 3.

In the Figures, 1 is a base body wherein the upper portion 3 thereof is formed into a hexangular nut form in the external contour and the hollow portion 3' of the portion 3 is formed into a square bore, while the lower portion 4 thereof is made into a cylinder like form having a hollow portion 4' of circular bore. 2 is a partitioning plate portion arranged between hollows 3' and 4'. 5 is a cut-out portion formed in the lower portion 4, which is in registration with the hollow 4'. 6 is a pawl housed in the cut-out portion 5 and mounted on an axis 7 in a turning fit, the axis 7 being attached on the base body 1 in parallel relation with the longitudinal axis of the base body 1. 8 is a ratchet wheel arranged rotatably in the hollow portion 4' by a rotating axis 9 in engaging relation with the pawl 6. The axis 9 is formed with a bore 10' in the upper surface thereof, into which a protrusion 10 of the partitioning plate portion 2 is fitted to hold rotatably the upper portion of the axis 9, while the intermediate portion of the axis 9 is mounted on the base body 1 in a running fit by a holding ring 12 and a washer 11. The lower end portion of the axis 9 is protruded downwardly and is formed into a regular prism. 13 is a well-known come-out stopper actuated by a spring 14. 15 is a hollow portion formed in the partitioning plate portion 2 in the direction crossed at right angles to the longitudinal axis of the base body 1, into which a pin member 16 preventing reversal of the ratchet motion is slidably housed, along with a spring 16'. The end portion of the pin 16 is adapted aloways to touch and push the face of the pawl 6 by the spring 16' as shown in FIGS. 4 and 5. 17 is a circular bore penetrating the nut-like portion 3 of the base body 1 in the direction crossed at right angles to the longitudinal axis of the portion 3.

Figures 1, 2, 3:
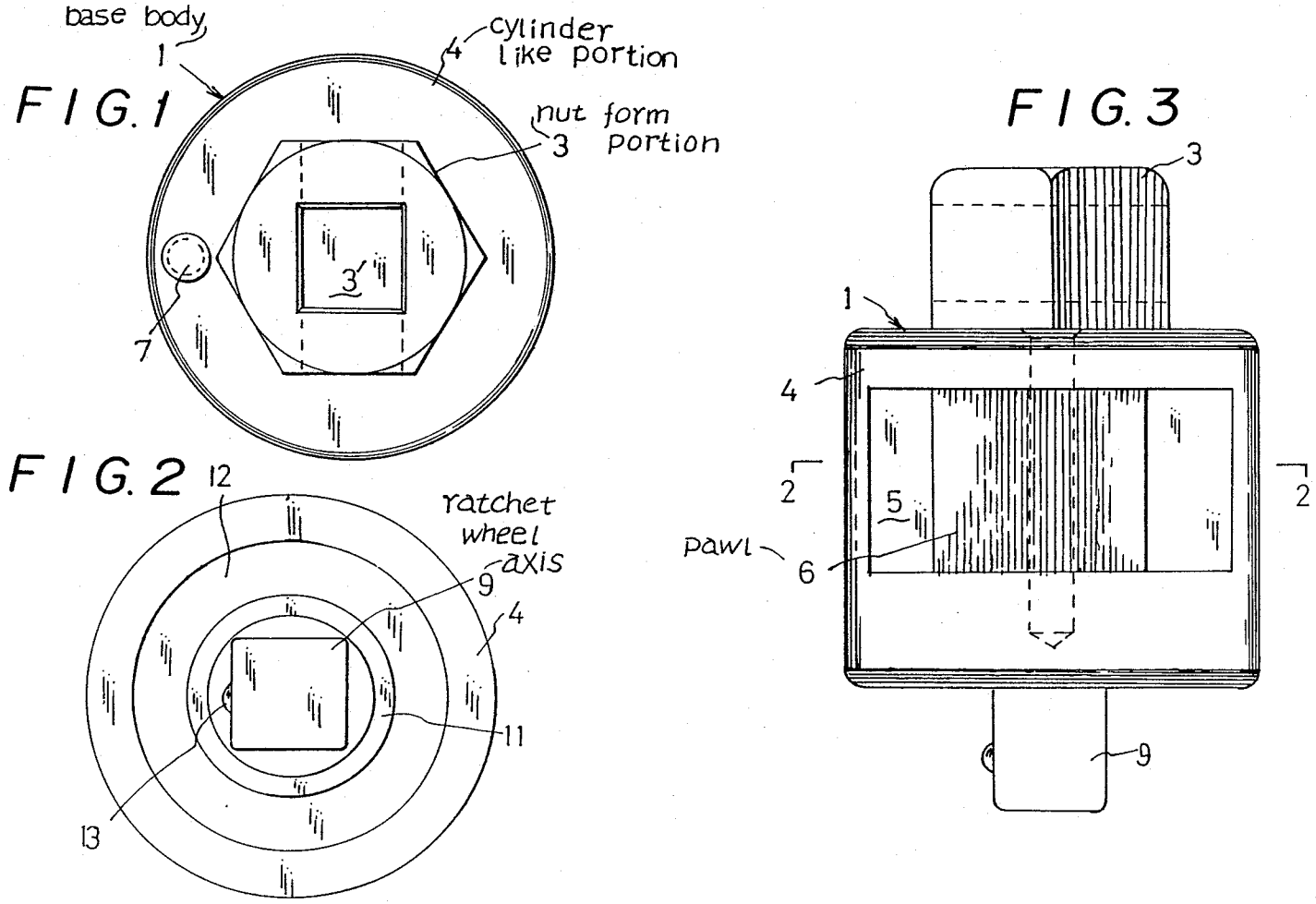
FIG. 1 is a plan view of a preferred embodiment of the invention.
FIG. 2 is a bottom view of the same.
FIG. 3 is a side elevation of the same.
Figure 5:
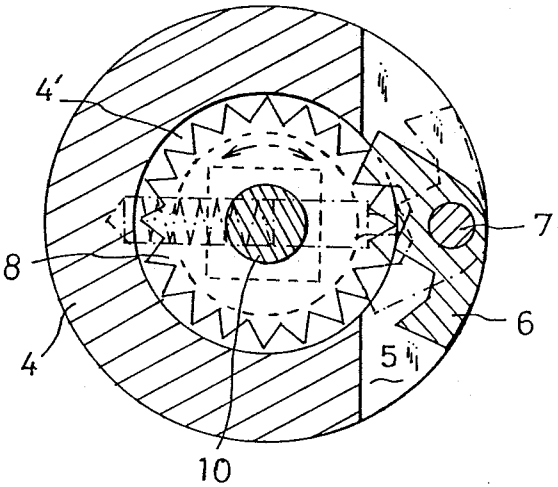
FIG. 5 is a cross-sectional view of line 2—2 of FIG. 3.

In operation, as the pawl 6 is rotated about the axis 7 into the position shown in FIG. 5 (in this time, the pawl 6 will be prevented from its free rotation in virtue of the pin member 16), the axis 9 will be able to ratchet in a anticlockwise direction according to the rotation of the protruded lower end portion of the axis 9. When the pawl 6 is placed at the position shown in dot-dash line in FIG. 7, the ratcheting direction of the axis 9 will be reversed. Accordingly, in consideration of such circumstance, it will be obvious that the utilization of the portio 3 and the extruded portion of the axis 9 which are provided with adaptable portions respectively to the marketing screw-rotating tools, as nut-like outer portion of the portion 3, circular bore 17, hollow portion 3', regular prism-shaped portion of the axis 9, will permit to effect quite easily ratcheting motion to the maltifarious objects.

According to this ratchet device, in addition to said effect, it possesses the advantage that it can be compactly constructed because the pin member 16 is housed in the hollow portion 15 formed in the partitioning plate portion 2. Further, it is more economical to manufacture because of its easily fabricatable construction.

I claim:

1. A ratchet device for driving a rotatable tool, comprising a body having an upper portion and a lower portion, said upper portion having a top part comprising at least three outer wide walls extending from said lower portion, a hollow hole having at least three inner side walls and an axis, and a penetrating circular bore extending at right angles to said axis of said hollow hole, said lower portion having a hollow part and a cut-out part;

a partition plate disposed between said hollow part of said lower portion and said hollow hole of said upper portion, and having a hollow cylindrical cavity, said hollow cylindrical cavity having an axis perpendicular to an axis of a ratchet wheel;

a pawl disposed in said cut-out part and movable to a first position to enable said ratchet wheel to turn in one direction, and to a second position to enable said ratchet wheel to turn in another direction, and accessible for manual movement to said first and second positions;

said ratchet wheel being disposed in said hollow part of said lower portion and engageable with said pawl;

a projecting portion having a part extending from and rotatable with said ratchet wheel and having the same axis as said ratchet wheel: and a pin member disposed in said hollow cylindrical cavity of said partition plate and movable in a direction perpendicular to said axis of said ratchet wheel against said pawl to prevent reversal of said ratchet wheel, so that the upper portion is drivable by different types of hand tools holding the outer side walls, the inner side walls or the bore of the top part of the upper portion, and the projecting portion is insertable into a rotatable tool, and rotation of the device by one of the different types of hand tools causes rotation of the projecting portion in one or another direction depending on the manually set position of the pawl, with the pin member acting against the pawl to prevent reverse direction rotation of the ratchet wheel.

* * * * *